US010741944B2

(12) United States Patent
Long

(10) Patent No.: US 10,741,944 B2
(45) Date of Patent: Aug. 11, 2020

(54) ELECTRICAL CONNECTOR IMPROVING HIGH-FREQUENCY CHARACTERISTICS

(71) Applicant: LOTES CO., LTD, Keelung (TW)

(72) Inventor: Quan Long, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/548,968

(22) Filed: Aug. 23, 2019

(65) Prior Publication Data

US 2020/0067216 A1 Feb. 27, 2020

(30) Foreign Application Priority Data

Aug. 23, 2018 (CN) ..... 2018 1 0968082
Sep. 3, 2018 (CN) ..... 2018 1 1018362

(51) Int. Cl.
*H01R 12/72* (2011.01)
*H01R 12/70* (2011.01)
(Continued)

(52) U.S. Cl.
CPC ..... *H01R 12/7082* (2013.01); *H01R 12/7005* (2013.01); *H01R 12/724* (2013.01); *H01R 13/11* (2013.01); *H01R 13/42* (2013.01); *H01R 13/502* (2013.01); *H01R 13/6471* (2013.01); *H01R 13/6582* (2013.01); *H01R 12/721* (2013.01); *H01R 12/89* (2013.01); *H01R 12/91* (2013.01); *H01R 13/703* (2013.01); *H01R 31/06* (2013.01); *H01R 2107/00* (2013.01)

(58) Field of Classification Search
CPC ..... H01R 12/721; H01R 12/89; H01R 12/91; H01R 13/703; H01R 31/06
See application file for complete search history.

(56) References Cited

U.S. PATENT DOCUMENTS 3,710,303 A * 1/1973 Gallager, Jr. ..... H01R 12/87 439/593
5,308,249 A * 5/1994 Renn ..... H01R 12/79 439/62

(Continued)

FOREIGN PATENT DOCUMENTS

CN 201167177 Y 12/2008
CN 201674041 U 12/2010

(Continued)

*Primary Examiner* — Tho D Ta
(74) *Attorney, Agent, or Firm* — Locke Lord LLP; Tim Tingkang Xia, Esq.

(57) ABSTRACT

An electrical connector is provided to be mated with a mating component. The electrical connector includes: a main body extending along a transverse direction; multiple terminals fixed to the main body and arranged along the transverse direction; and at least one insulating member connected with the main body and provided above the terminals. When the mating component is mated with the electrical connector, the terminals are electrically connected with the mating component, and each insulating member is in contact with at least one corresponding terminal, such that the insulating member move in a vertical direction and a front-rear direction simultaneously, which is equivalent to the case where a section of each terminal exposed from the main body is turned to be covered by the insulating member instead of being exposed in air.

20 Claims, 11 Drawing Sheets

(51) Int. Cl.

| | |
|---|---|
| ***H01R 13/502*** | (2006.01) |
| ***H01R 13/11*** | (2006.01) |
| ***H01R 13/42*** | (2006.01) |
| ***H01R 13/6582*** | (2011.01) |
| ***H01R 13/6471*** | (2011.01) |
| *H01R 107/00* | (2006.01) |
| *H01R 12/89* | (2011.01) |
| *H01R 13/703* | (2006.01) |
| *H01R 31/06* | (2006.01) |
| *H01R 12/91* | (2011.01) |

(56) References Cited

U.S. PATENT DOCUMENTS

| | | | | |
|---|---|---|---|---|
| 6,350,153 | B1 * | 2/2002 | Lee | H01R 12/721 439/592 |
| 6,416,342 | B2 * | 7/2002 | Matsumura | H01R 12/87 439/267 |
| 7,497,713 | B1 * | 3/2009 | Huettner | H01R 27/00 439/265 |

FOREIGN PATENT DOCUMENTS

| | | | |
|---|---|---|---|
| CN | 101369693 | B | 12/2011 |
| CN | 203242844 | U | 10/2013 |
| CN | 203536644 | U | 4/2014 |
| CN | 207098136 | U | 3/2018 |
| WO | 2017218771 | A1 | 12/2017 |

* cited by examiner

ELECTRICAL CONNECTOR IMPROVING HIGH-FREQUENCY CHARACTERISTICS

CROSS-REFERENCE TO RELATED PATENT APPLICATION

This non-provisional application claims priority to and the benefit of, pursuant to 35 U.S.C. § 119(a), patent application Serial No. CN201810968082.7 filed in China on Aug. 23, 2018 and patent application Serial No. CN201811018362.8 filed in China on Sep. 3, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector which may improve the high-frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector generally includes an insulating body, terminals accommodated in the insulating body, and a shell wrapping outside the insulating body. In a slot type electrical connector, the terminals are generally elastic terminals. When the elastic terminals are fixed to the insulating body, each elastic terminal is required to protrude and extend out of the body with an extremely long section to be exposed in air in order to elastically deform normally during the contact with a mating component. However, in order to achieve ideal high-frequency characteristics, it is required that a portion of each terminal located inside the insulating body and a portion of each terminal located outside the insulating body reach a balanced impedance value. When the extremely long section of the elastic terminal is exposed in the air, due to the difference between the dielectric constants of the insulating body and the air, the impedance of the portion being exposed in the air is higher than the impedance of the portion being located inside the insulating body, which may affect the high-frequency characteristics.

Therefore, a heretofore unaddressed need to design a new electrical connector exists in the art to address the aforementioned deficiencies and inadequacies.

SUMMARY

The present invention is directed to provide an electrical connector which may improve the high-frequency characteristics.

To achieve the foregoing objective, the present invention adopts the following technical solutions:

An electrical connector is configured to be mated with a mating component. The electrical connector includes: a main body, extending along a transverse direction; a plurality of terminals, fixed to the main body and arranged along the transverse direction; and at least one insulating member, connected with the main body and provided above the terminals, wherein when the mating component is mated with the electrical connector, the terminals are electrically connected with the mating component, and each of the at least one insulating member is in contact with at least one corresponding terminal of the terminals, such that the insulating member move in a vertical direction and a front-rear direction simultaneously.

In certain embodiments, the main body has a grounding member, and at least one fixing arm extends from the grounding member and is connected with the insulating member.

In certain embodiments, the terminals include at least one pair of differential signal terminals, and when the mating component is not mated with the electrical connector, the insulating member is in contact with the at least one pair of differential signal terminals.

In certain embodiments, when the mating component is not mated with the electrical connector, the insulating member is in contact with the at least one corresponding terminal, a contact area of the insulating member and the at least one corresponding terminal when the mating component is not mated with the electrical connector is smaller than the contact area of the insulating member and the at least one corresponding terminal when the mating component is completely mated with the electrical connector.

In certain embodiments, the insulating member has an inclined surface, a portion of the inclined surface is not in contact with the at least one corresponding terminal when the mating component is not mated with the electrical connector, and the whole inclined surface is in contact with the at least one corresponding terminal when the mating component is completely mated with the electrical connector.

In certain embodiments, the inclined surface is a lower surface of the insulating member slantly extending upward and backward from front thereof, and the inclined surface includes a first region and a second region provided in the front-rear direction; when the mating component is not mated with the electrical connector, only the first region is in contact with an upper surface of each of the at least one corresponding terminal; and when the mating component is mated with the electrical connector and is in contact with the lower surface of each of the terminals, both the first region and the second region are in contact with the upper surface of each of the at least one corresponding terminal.

In certain embodiments, the insulating member is not in contact with the mating component.

In certain embodiments, each of the terminals includes an extending section extending out of the main body, and the insulating member is provided on the extending section.

In certain embodiments, the extending section includes a contact portion located at a front end thereof and a connecting portion extending backward from the contact portion, the contact portion is electrically connected with the mating component, and the insulating member is located right above the connecting portion.

In certain embodiments, the electrical connector further includes a plurality of insulating members and a shell accommodating the main body, the terminals and the insulating members, wherein the shell has a socket and a plurality of reserved slots located at one side of the socket and communicated with the socket, each of the insulating members is accommodated in at least one corresponding reserved slot of the reserved slots, and the extending section of each of the terminals is accommodated in a corresponding one of the reserved slots and is partially exposed from the socket.

The present invention further provides another electrical connector configured to be mated with a mating component. The electrical connector includes: a main body, extending along a transverse direction; a plurality of terminals, fixed to the main body and arranged along the transverse direction, wherein the terminals includes at least one pair of differential signal terminals; and at least one insulating member, connected with the main body and provided on at least one corresponding pair of the differential signal terminals or directly fixed to the at least one corresponding pair of the differential signal terminals, wherein when the mating component is mated with the electrical connector, the mating component is electrically connected with the terminals, each of the at least one insulating member is in contact with the at least one corresponding pair of the differential signal terminals, and the at least one corresponding pair of the differential signal terminals drives a corresponding one of the at least one insulating member to move.

In certain embodiments, the main body has a grounding member, and at least one fixing arm extends from the grounding member and is connected with the insulating member.

In certain embodiments, the insulating member is attached to surfaces of the at least one corresponding pair of the differential signal terminals or is injection-molded and wraps outside the at least one corresponding pair of the differential signal terminals.

In certain embodiments, when the mating component is not mated with the electrical connector, the insulating member is in contact with the at least one corresponding pair of the differential signal terminals, a contact area of the insulating member and the at least one corresponding pair of the differential signal terminals when the mating component is not mated with the electrical connector and the contact area of the insulating member and the at least one corresponding pair of the differential signal terminals when the mating component is completely mated with the electrical connector are same.

In certain embodiments, when the mating component is not mated with the electrical connector, the insulating member is in contact with the at least one corresponding pair of the differential signal terminals, a contact area of the insulating member and the at least one corresponding pair of the differential signal terminals when the mating component is not mated with the electrical connector and the contact area of the insulating member and the at least one corresponding pair of the differential signal terminals when the mating component is completely mated with the electrical connector are different.

In certain embodiments, when the mating component is completely mated with the electrical connector, the mating component is electrically connected with a lower surface of each of the at least one corresponding pair of the differential signal terminals, the insulating member has an inclined surface, and a contact area of the inclined surface and upper surfaces of each of the at least one corresponding pair of the differential signal terminals reaches a maximum value.

In certain embodiments, the insulating member has an inclined surface slantly extending upward and backward from front thereof, and the inclined surface includes a first region and a second region provided in a front-rear direction; when the mating component is not mated with the electrical connector, a contact area of the first region and upper surfaces of the at least one corresponding pair of the differential signal terminals is larger than a contact area of the second region and the upper surfaces of the at least one corresponding pair of the differential signal terminals; and when the mating component is completely mated with the electrical connector, the contact area of the first region and the upper surfaces of the at least one corresponding pair of the differential signal terminals is smaller than the contact area of the second region and the upper surfaces of the at least one corresponding pair of the differential signal terminals.

In certain embodiments, when the mating component is mated with the electrical connector, the differential signal terminals are in contact with the mating component, each of the at least one insulating member is in contact with the at least one corresponding pair of the differential signal terminals, and the insulating member moves in a vertical direction and a front-rear direction simultaneously.

In certain embodiments, each of the terminals includes an extending section extending out of the main body, and the insulating member is provided on the extending section of the at least one corresponding pair of the differential signal terminals.

In certain embodiments, the electrical connector includes a plurality of insulating members and a shell accommodating the main body, the terminals and the insulating members, wherein the shell has a socket and a plurality of reserved slots located at one side of the socket and communicated with the socket, each of the at least one pair of the differential signal terminals and a corresponding one of the insulating members are accommodated in a corresponding pair of the reserved slots, the two reserved slots in each pair of the reserved slots are in communication with each other, and the extending section of each of the terminals is accommodated in a corresponding one of the reserved slots and is partially exposed from the socket.

Compared with the related art, in certain embodiments of the present invention, by the arrangement of the insulating member, when the mating component is inserted therein, the mating component is electrically connected with the terminals, and at least one of the terminals is elastically deformed in the vertical direction to be in contact with the insulating member, so as to better provide a normal force, such that the terminals and the mating component are in stable contact. Further, when the mating component is completely inserted therein, the surface of at least one corresponding terminal of the terminals is in contact with the insulating member, which is equivalent to the case where a section of each corresponding terminal exposed from the main body is turned to be covered by the insulating member instead of being exposed in air. Since the dielectric constant of the insulating member is greater than that of the air, an effect of reducing the impedance of the terminal may be achieved, so as to make the portion of each terminal being exposed in the air and the portion of each terminal being located inside the main body reach an impedance balance state, and finally to improve the high-frequency characteristics.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
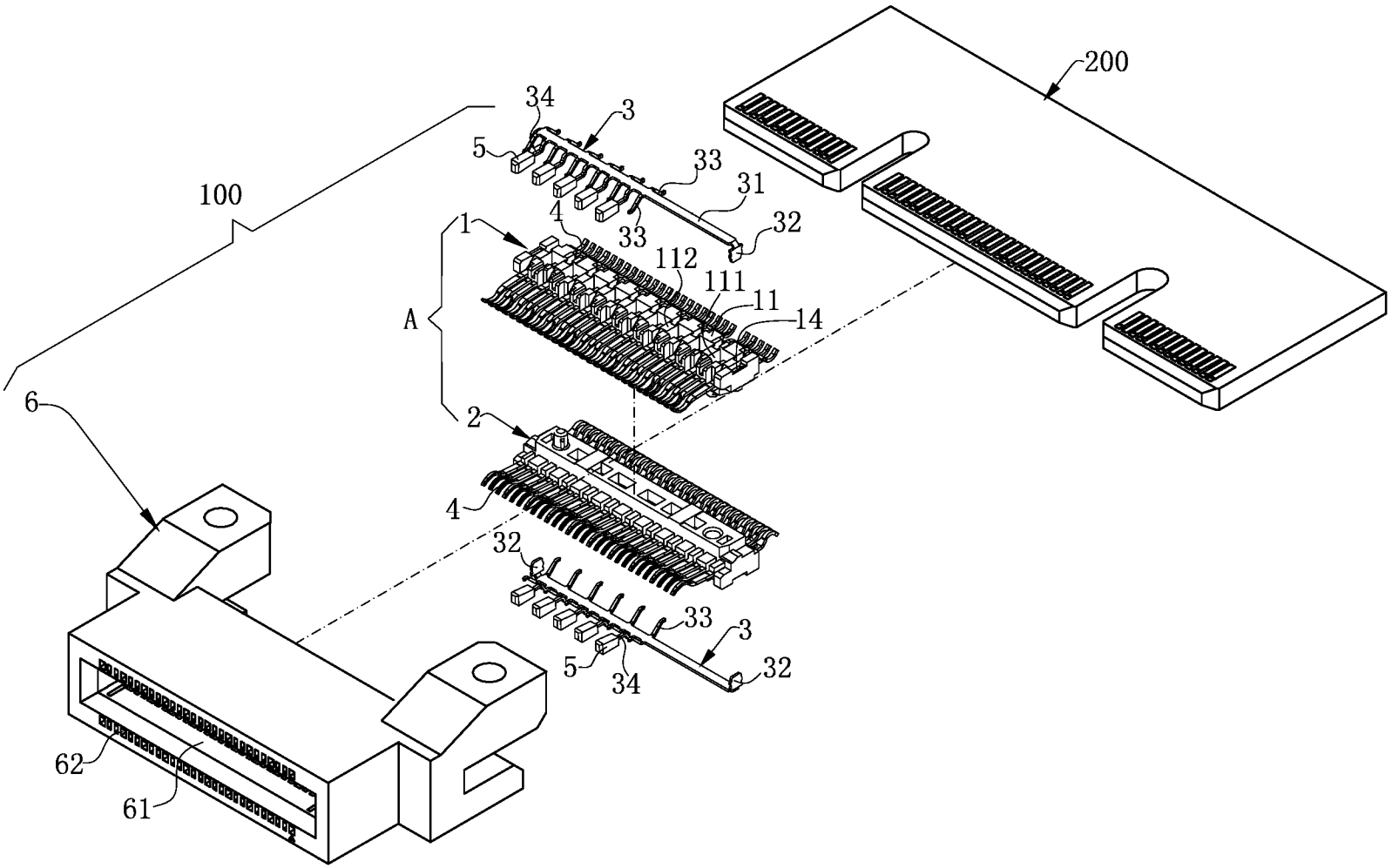
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

FIG. 1 to FIG. 7 show an electrical connector 100 according to a first embodiment of the present invention. The electrical connector 100 is soldered on a circuit board 200 to be mated with a mating component 300, and has with a main body A (which is formed by an upper insulating body 1 and a lower insulating body 2), a grounding member 3, multiple terminals 4, multiple insulating members 5 and a shell 6.

Figure 2:
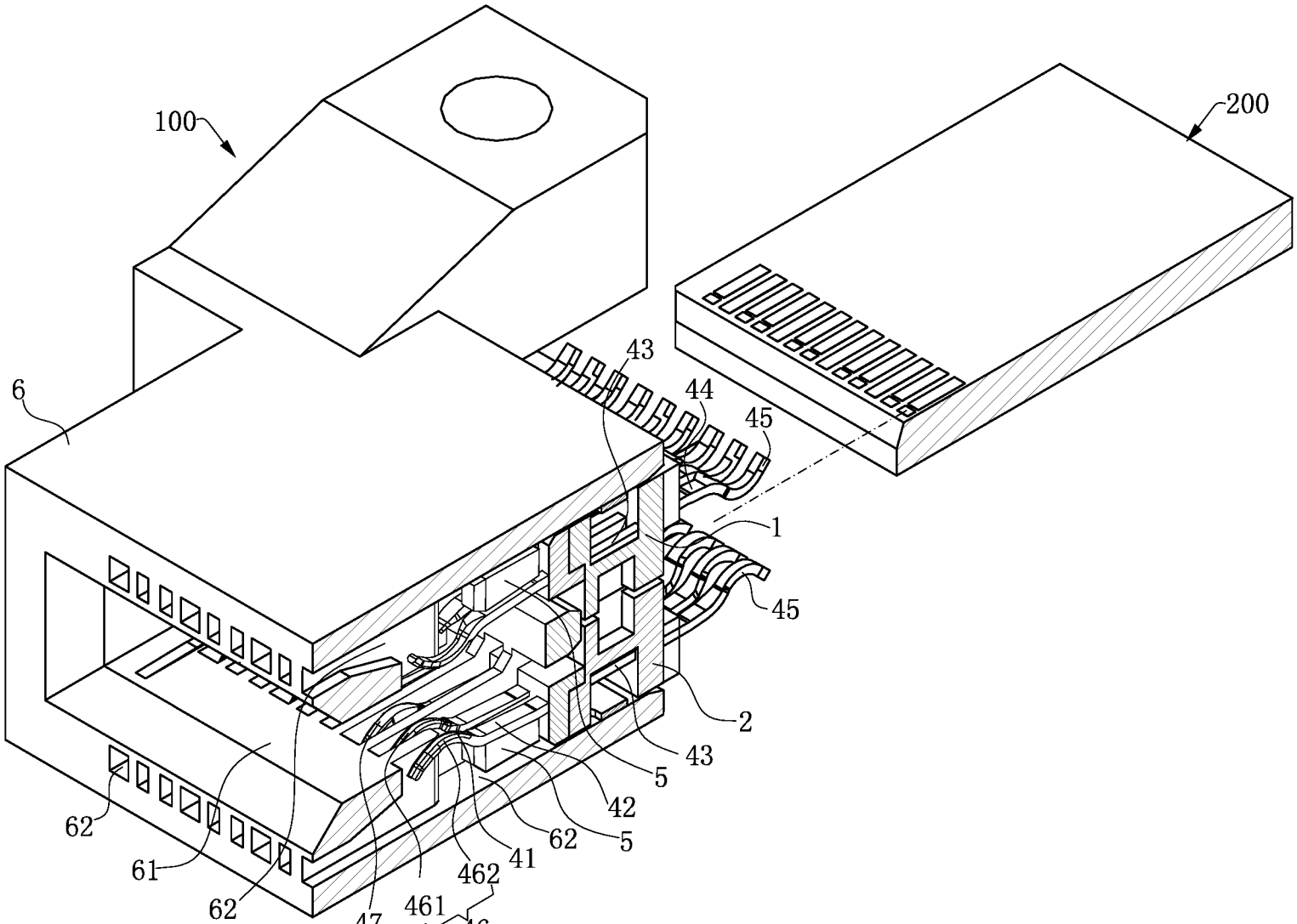
FIG. 2 is a sectional view of FIG. 1.
Figure 3:
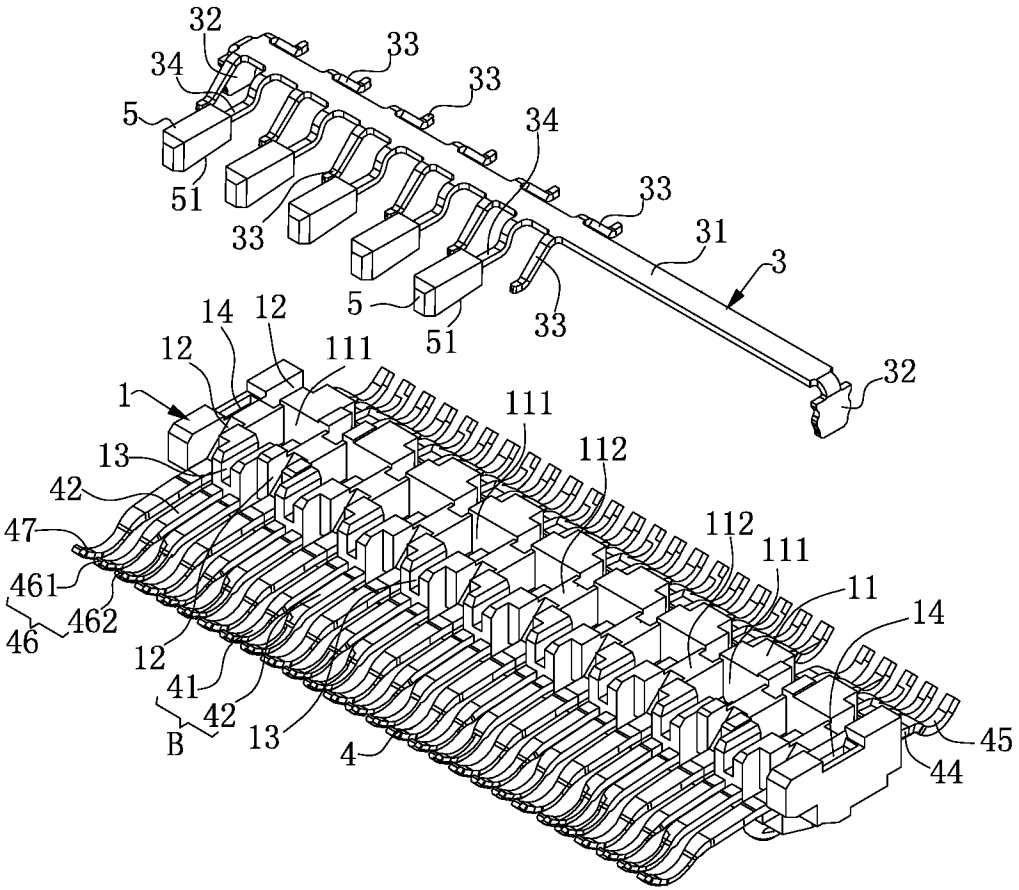
FIG. 3 is a perspective exploded view of part of the components in FIG. 1.

Referring to FIG. 1 to FIG. 3, the upper insulating body 1 and the lower insulating body 2 are assembled in an up-down direction (which is equivalent to a vertical direction) to form the main body A. The upper insulating body 1 includes a base portion 11, multiple first grooves 12, multiple second grooves 13 and two retaining slots 14. A center of the base portion 11 is concavely provided with multiple base slots 111 on the outer surface thereof. The base slots 111 are arranged along a transverse direction, and adjacent base slots 111 are separated by a barrier 112. The first grooves 12 are located on the two opposite sides in front of and behind the base portion 11. The first grooves 12 located at the front and the first grooves 12 located at the rear are located in the same straight line, and are all isolated from the base slots 111 without communication therebetween. The second grooves 13 are provided on the front side of the base portion 11, and the second grooves 13 and the first grooves 12 are all arranged along the transverse direction and provided at intervals. The second grooves 13 are communicated with the base slots 111. The two retaining slots 14 are respectively located at two transverse ends of the base portion 11 and are adjacent to the barriers 112 at the outermost sides. The lower insulating body 2 is structurally similar to the upper insulating body 1, and descriptions thereof are not hereinafter elaborated.

Figure 4:
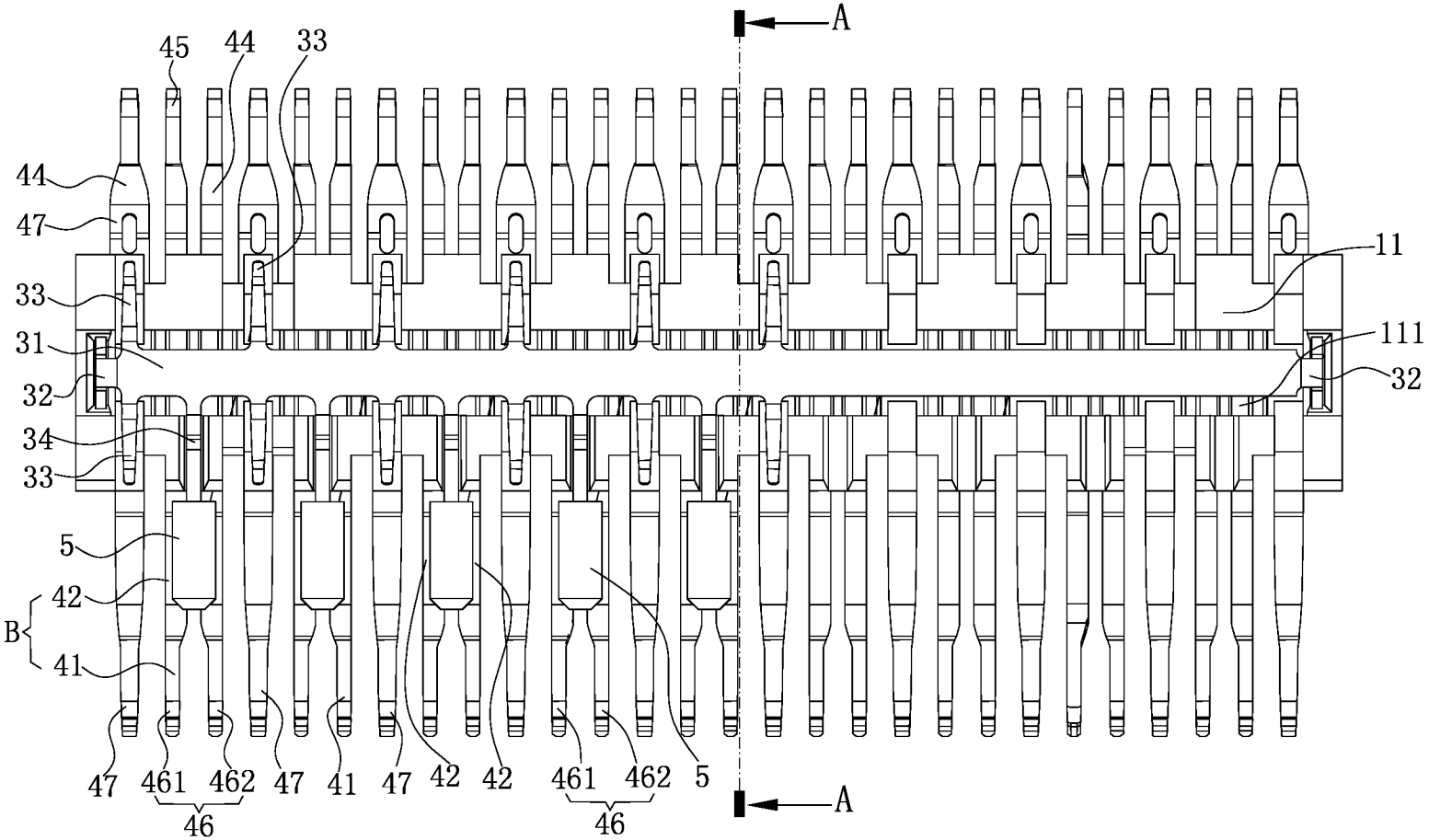
FIG. 4 is a top view of FIG. 3 after assembly is complete.

Referring to FIG. 1, FIG. 3 and FIG. 4, two grounding members 3 are provided and have identical structures, and are provided vertically symmetrical to each other and respectively fixed to the upper insulating body 1 and the lower insulating body 2. Using the grounding member 3 located above as an example, the grounding member 3 includes a base plate 31, retaining arms 32 respectively bending and extending downward from two transverse ends of the base plate 31, multiple elastic sheets 33 symmetrically extending from the front side and the rear side of the base plate 31, and multiple fixing arms 34 bending and extending from the front side of the base plate 31. The base plate 31 is provided at an upper side of the base slots 111. The upper surfaces of the barriers 112 abut a lower surface of the base plate 31, so as to provide support for the grounding member 3. The retaining arms 32 bend and extend to enter the retaining slots 14, so as to retain the grounding member 3 such that it is not easy to loosen. The elastic sheets 33 enter the first grooves 12 and are located in the first grooves 12. The fixing arms 34 enter the second grooves 13, and the front ends of the fixing arms 34 protrude out of the front end surfaces of the second grooves 13.

Referring to FIG. 1 to FIG. 5, the terminals 4 are divided into an upper row and a lower row and are respectively injection-molded in the upper insulating body 1 and the lower insulating body 2. The terminals 4 in the upper row and the lower row are arranged transversely and have identical structures. Using the terminals 4 in the upper row as an example, each terminal 4 includes an extending section B (which is formed by a contact portion 41 and a connecting portion 42), a retaining portion 43, a protruding portion 44 and a soldering portion 45. The contact portion 41 is elastic and is located at a front end of the corresponding terminal 4, and may elastically deform upward when electrically connected with the mating component 300. The connecting portion 42 extends backward from the contact portion 41 and is located in front of the upper insulating body 1, and may follow the contact portion 41 to move in the same direction. The retaining portion 43 extends backward from the connecting portion 42 and is located inside the upper insulating body 1 to retain the corresponding terminal 4. The protruding portion 44 and the soldering portion 45 extend backward from the retaining portion 43 in sequence, so as to be exposed outside the upper insulating body 1. The soldering portion 45 is elastic, and when the electrical connector 100 clamps the circuit board 200, the soldering portion 45 may provide a guiding function and does not to damage the corresponding terminal 4. The terminals 4 include five differential signal pairs 46 and multiple grounding terminals 47 for separating each differential signal pair 46. Each differential signal pair 46 includes a first differential signal terminal 461 and a second differential signal terminal 462 provided adjacent to each other. The retaining portion 43 of each grounding terminal 47 is partially exposed in the first groove 12 and is in contact with the elastic sheet 33.

Referring to FIG. 1 to FIG. 5, multiple insulating members 5 are divided into an upper row and a lower row and are molded separately from the upper insulating body 1 and the lower insulating body 2. The insulating members 5 in the upper row and the insulating members 5 in the lower row are provided vertically symmetrical to each other, and each insulating member 5 is injection-molded with a corresponding one of the fixing arms 34, so as to achieve connection with the upper insulating body 1 and the lower insulating body 2. In the present embodiment, the insulating members 5 are made of plastic materials. In other embodiments, the insulating members 5 may be made of other insulating materials having dielectric constants greater than that of air. Using the insulating members 5 located above as an example, each of the insulating members 5 is located in front of a corresponding one of the second grooves 13 and are provided on the connecting portions 42 of a corresponding one pair of the differential signal pairs 46, and are located between the transverse edges of the first differential signal terminals 461 and the second differential signal terminals 462 far away from each other. Each of the insulating members 5 located above has a first inclined surface 51 slantly extending upward and backward from front thereof, and each of the insulating members 5 located below has a second inclined surface 51' slantly extending downward and backward from front thereof. Each of the first inclined surface 51 and the second inclined surface 51' has a first region 511 and a second region 512 provided in the front-rear direction. A length and an area of the second region 512 are both greater than a length and an area of the corresponding first region 511.

Figure 5:
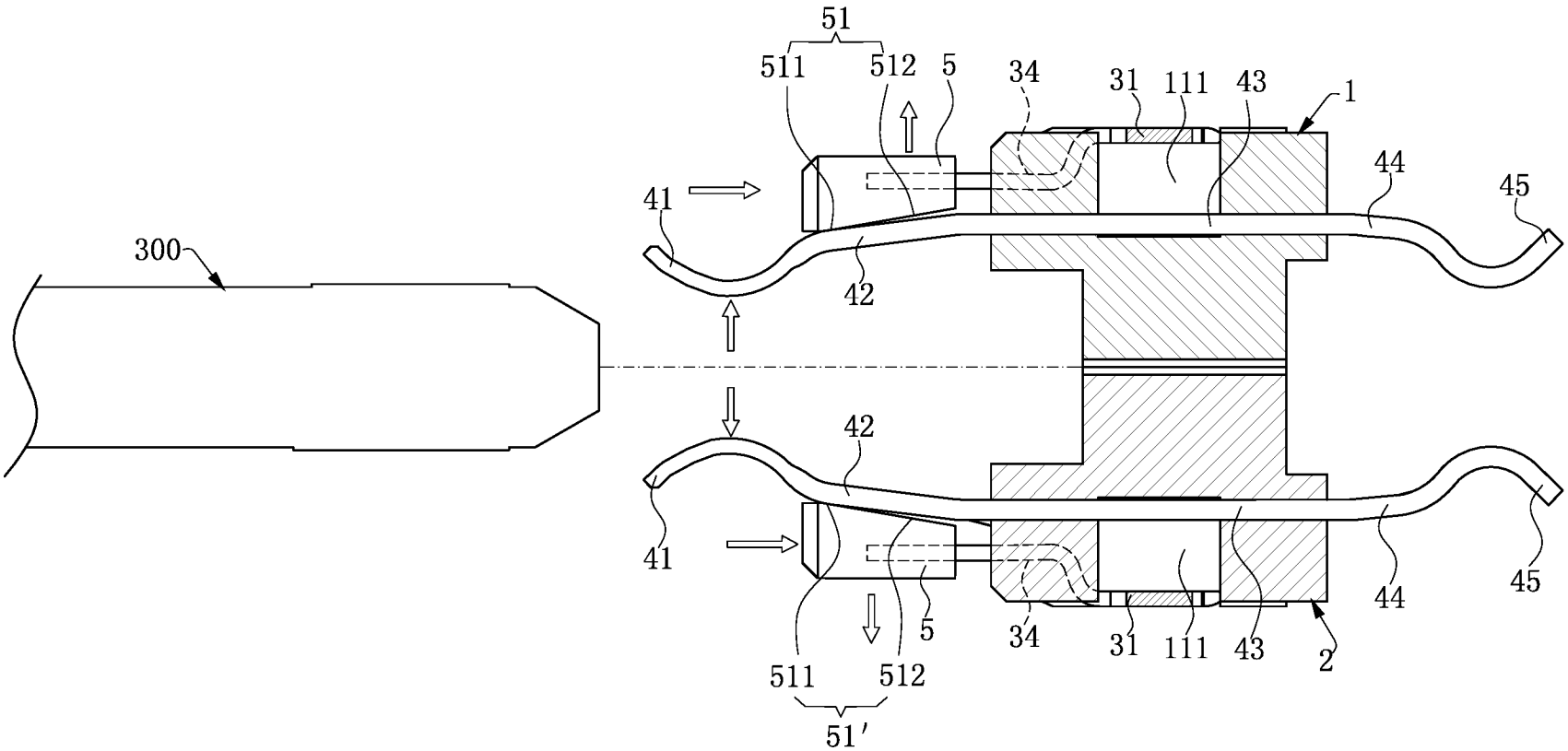
FIG. 5 is a sectional view of a mating component in FIG. 4 along a direction A-A before mating.
Figure 7:
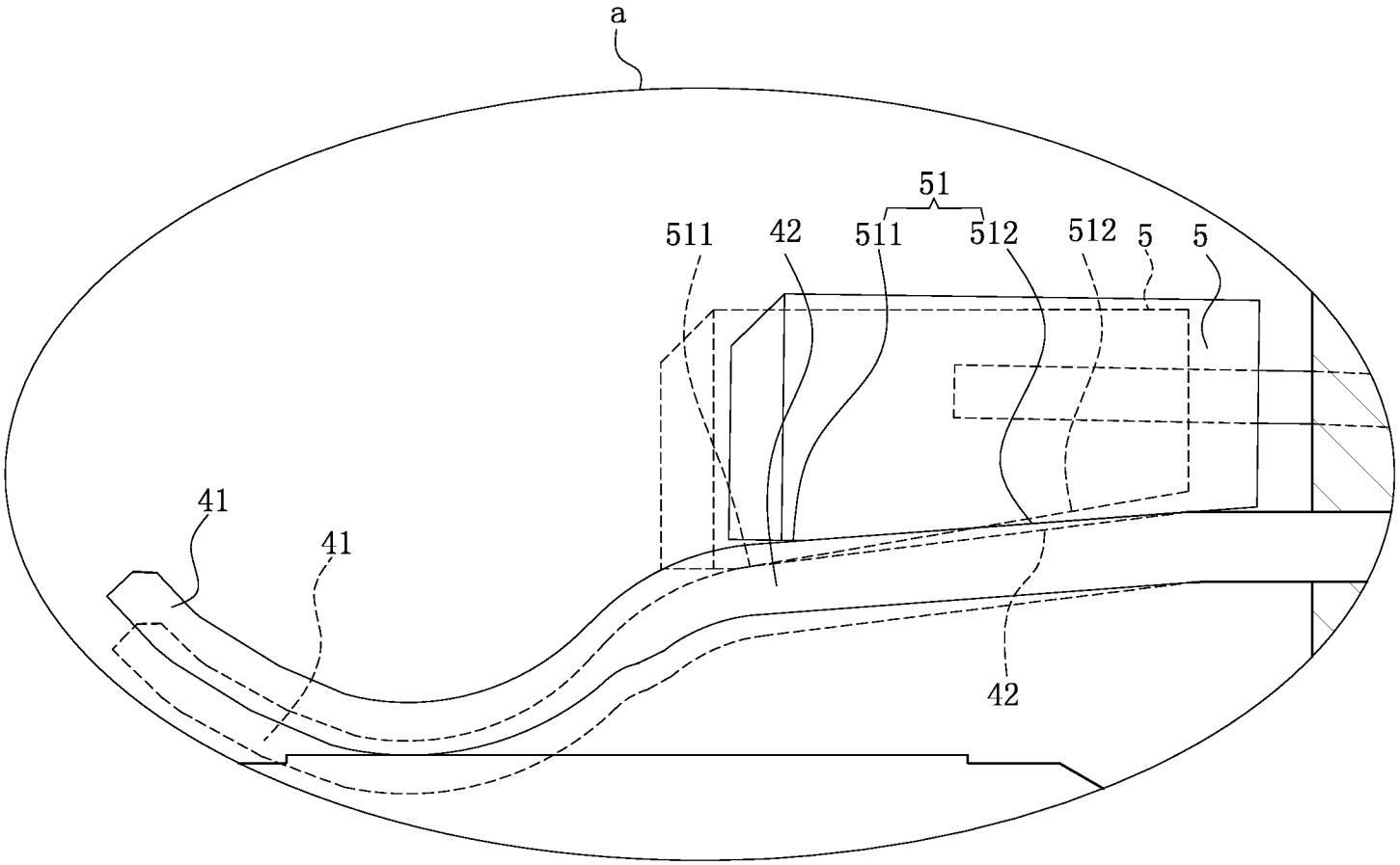
FIG. 7 is a partial enlarged view of FIG. 6.

Referring to FIG. 5 and FIG. 7, the dotted line portion in FIG. 7 represents a state before the mating component 300 is mated. Before the mating component 300 is mated, the first regions 511 abut the connecting portions 42 of the differential signal pairs 46, and the second regions 512 have gaps with the connecting portions 42 of the differential signal pairs 46 and are not in contact with the connecting portions 42 of the differential signal pairs 46. Using the insulating members 5 located above as an example, the first regions 511 abut the upper surfaces of the connecting portions 42 of the differential signal pairs 46 in the upper row, and the second regions 512 have gaps with the upper surfaces of the connecting portions 42 of the differential signal pairs 46 in the upper row.

Figure 6:
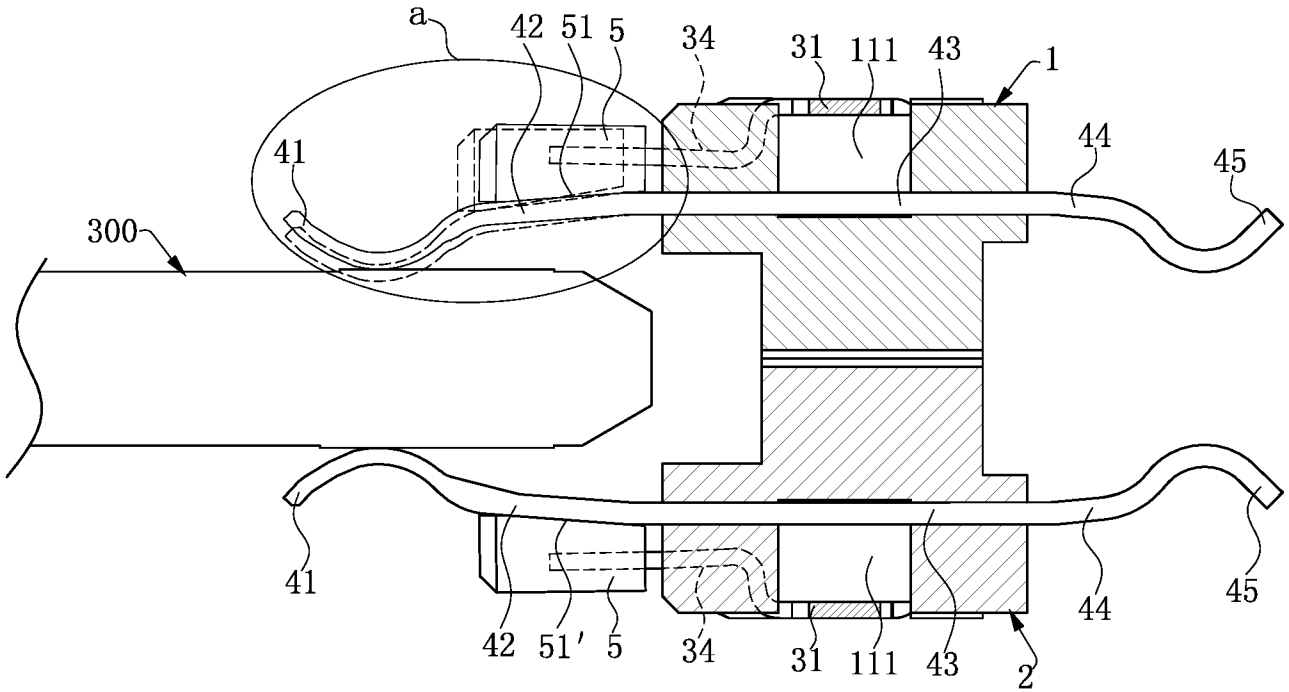
FIG. 6 is a sectional view of the mating component in FIG. 4 along the direction A-A after mating.

Referring to FIG. 6 and FIG. 7, the solid line portion in FIG. 7 represents a state after the mating component 300 is mated. When the mating component 300 is completely mated, the contact portions 41 are electrically connected with the mating component 300. The contact portions 41 located above and below respectively move upward and downward under the action of the mating component 300, and the movements of the contact portions 41 drive the connecting portions 42 to move toward the same direction as the contact portions 41. Thus, each of the insulating members 5 located above and below may be respectively driven by the connecting portions 42 of a corresponding one pair of the differential signal pairs 46, the insulating members 5 located above may move upward and backward simultaneously, and the insulating members 5 located below may move downward and backward simultaneously.

Meanwhile, the first regions 511 and the second regions 512 are attached to the surfaces of the connecting portions 42 of the differential signal pair 46 and in contact with the connecting portions 42 of the differential signal pair 46. Using the insulating members 5 located above as an example, when the mating component 300 is mated with the electrical connector 100 and is in contact with the lower surface of terminals 4 in the upper row, the first regions 511 and the second regions 512 of the insulating members 5 located above are attached to the upper surfaces of the connecting portions 42 of the differential signal pairs 46 in the upper row. In this case, contact areas of the connecting portions 42 of a corresponding one pair of the differential signal pairs 46 and the first inclined surfaces 51 as well as the second inclined surfaces 51' of the insulating members 5 reach the maximum areas. In another case, when the connecting portions 42 of a corresponding one pair of the differential signal pairs 46 have enough deformation amounts in the vertical direction, the insulating members 5 also generate relatively large movements. In this case, each of the insulating members 5 may apply a backward force to a corresponding one of the fixing arms 34, and each of the fixing arms 34 move backward to make the corresponding one of the insulating members 5 move backward. Therefore, the insulating members 5 move in the vertical direction and the front-rear direction simultaneously, and the insulating members 5 may further have relative movements (not shown in the figure) to the differential signal pair 46 in the front-rear direction. In addition, in the whole mating process, the insulating members 5 are not in contact with the mating component 300. The position relation between the insulating members 5 and the lower insulating body 2 and the position relationships between the insulating members 5 and the lower terminals 4 are identical to those as described above, and descriptions thereof are not hereinafter elaborated.

Referring to FIG. 1 and FIG. 2, the shell 6 encloses the upper insulating body 1, the lower insulating body 2 and the grounding members 3. The shell 6 has a socket 61 and multiple reserved slots 62 located on an upper side and a lower side of the socket 61. The socket 61 is communicated with the reserved slots 62 to allow the mating component 300 to be inserted therein, so as to complete the mating. The contact portions 41 are exposed in the socket 61 and are electrically connected with the mating component 300. The connecting portions 42 of each of the differential signal pairs 46 are accommodated in a corresponding pair of the reserved slots 62. The two reserved slots 62 in each pair of the reserved slots 62 are in communication with each other. Each of the insulating members 5 is accommodated in the corresponding pair of the reserved slots 62 in communication with each other to ensure that each of the insulating members 5 and the connecting portions 42 of the corresponding differential signal pair 46 are in contact with each other. The insulating members 5 are not exposed in the socket 61. Each of the insulating members 5 and the connecting portions 42 of the corresponding differential signal pair 46 may move vertically in the corresponding pair of the reserved slots 62.

Figure 8:
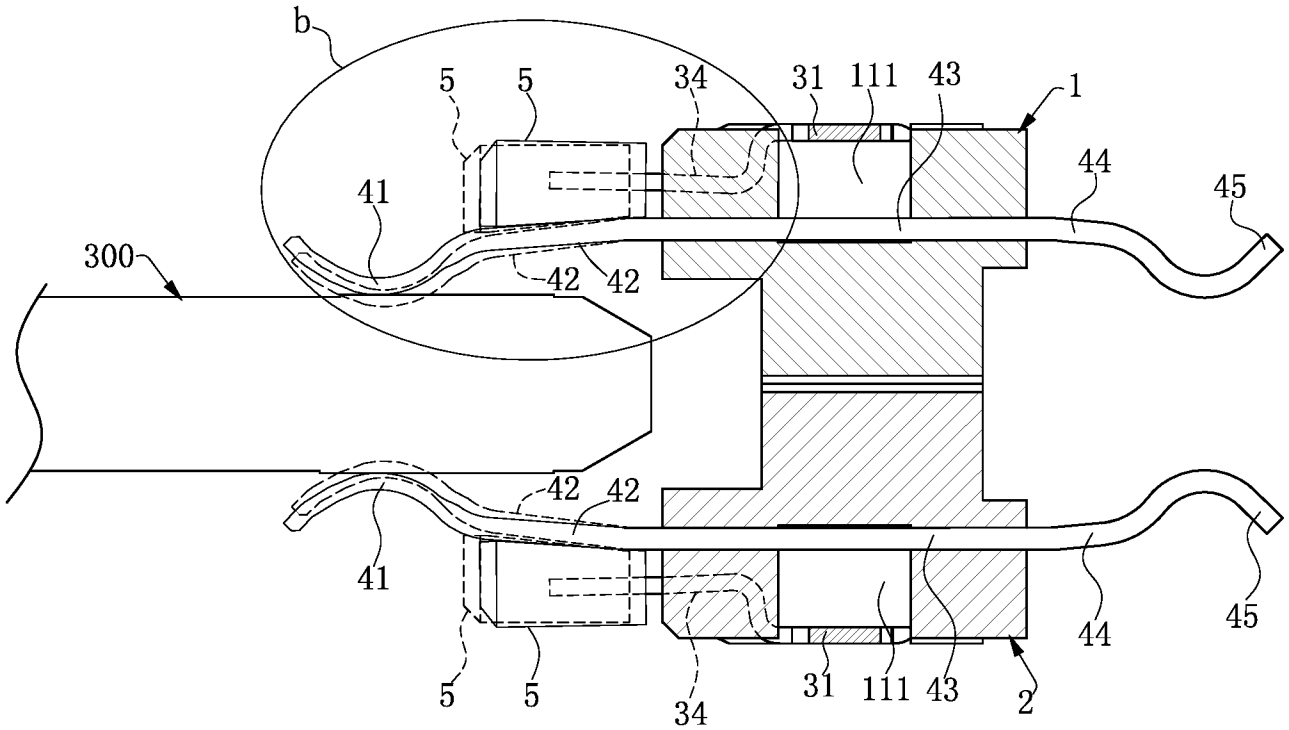
FIG. 8 is a sectional view according to a second embodiment of the present invention.
Figure 9:
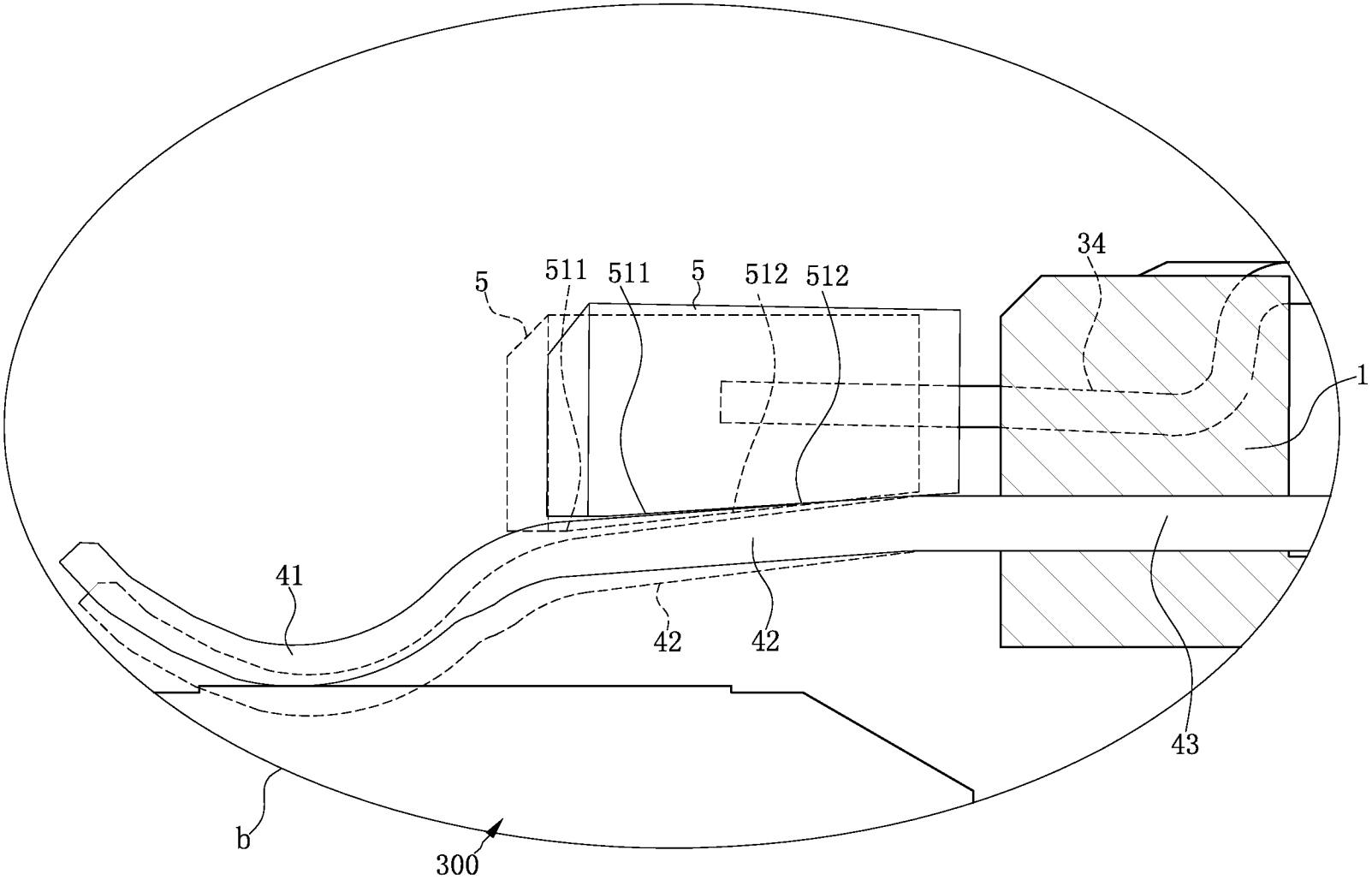
FIG. 9 is a partial enlarged view of FIG. 8.

FIG. 8 and FIG. 9 show a second embodiment of the present invention. The dotted lines in the figures represents states of the insulating members 5 and the terminals 4 when the mating component 300 is not mated. The difference of this embodiment from the first embodiment exists in that: when the mating component 300 is not mated, the insulating members 5 are in a suspended state, and gaps are formed between the insulating members 5 and the connecting portions 42 of the differential signal pairs 46. That is, the first regions 511 and the second regions 512 are both not in contact with the connecting portions 42 of the differential signal pairs 46. When the mating component 300 is mated, the mating component 300 is electrically connected with the contact portions 41 and drives the contact portions 41 to move, and the contact portions 41 drive the connecting portions 42 to move. Therefore, the connecting portions 42 of the differential signal pairs 46 move toward a direction away from the mating component 300 and are in contact with the first regions 511 and the second regions 512, so as to drive the insulating members 5 to move in the vertical direction and the front-rear direction.

Figure 10:
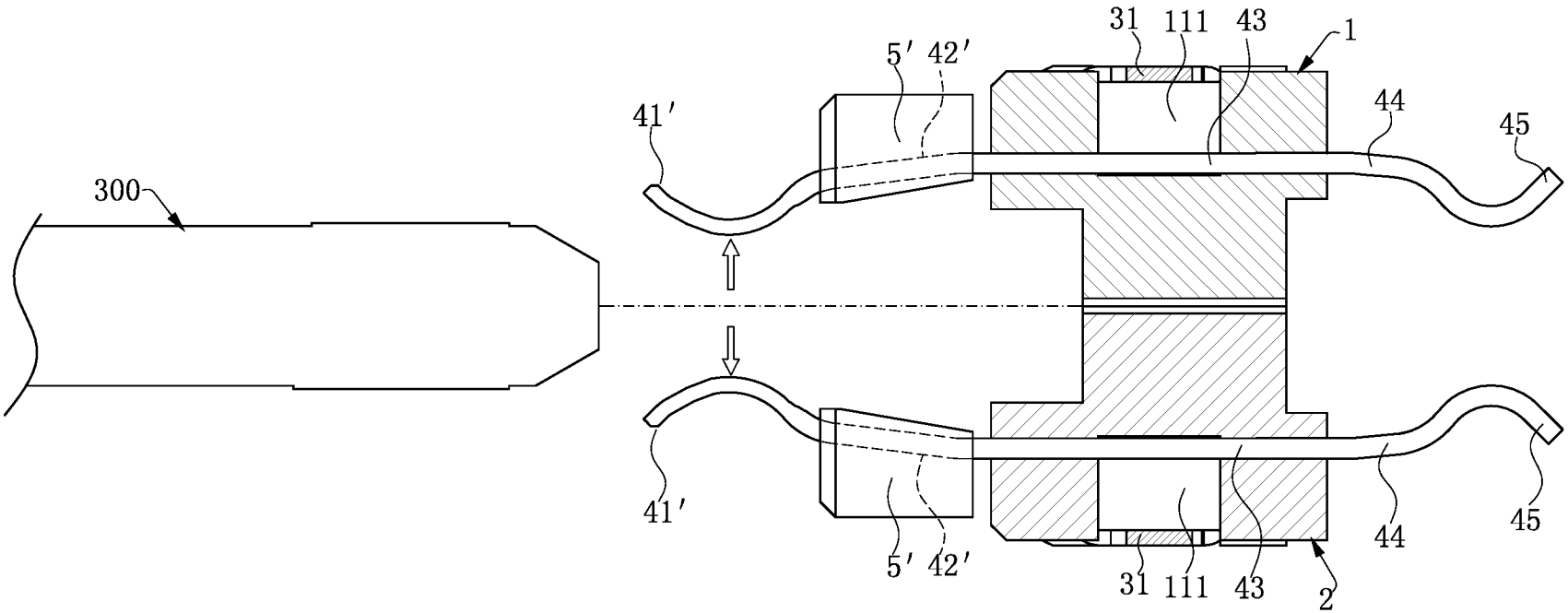
FIG. 10 is a sectional view of a mating component according to a third embodiment of the present invention before mating.
Figure 11:
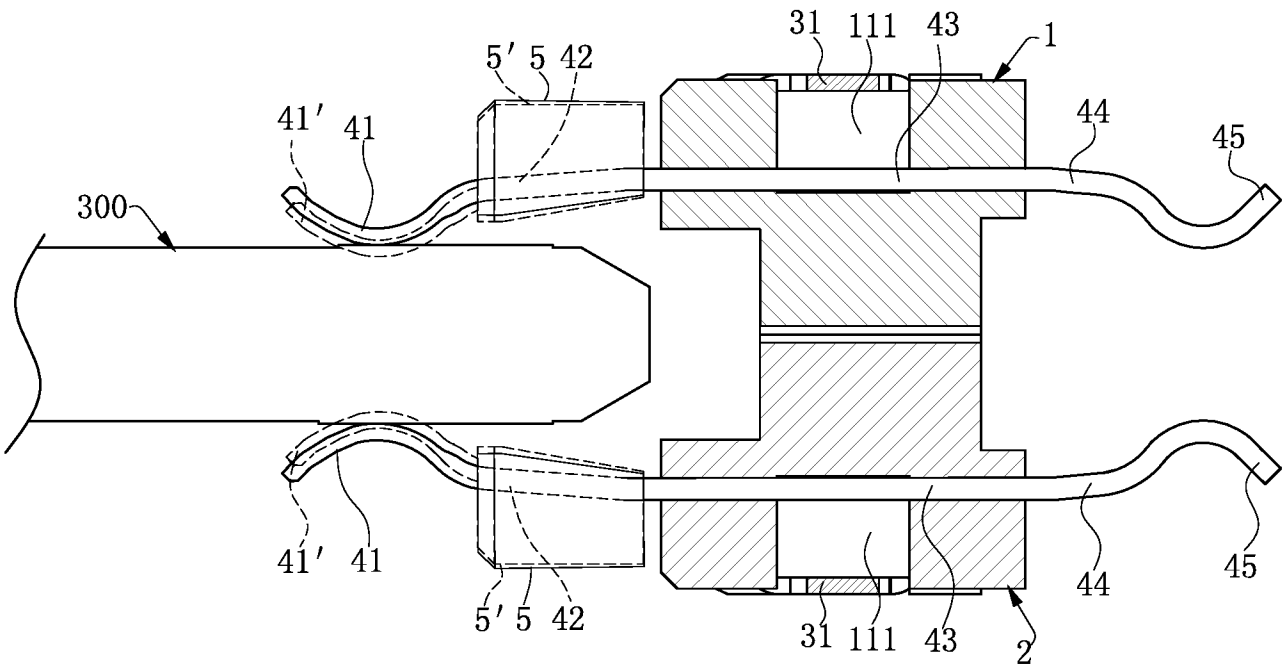
FIG. 11 is a sectional view of the mating component according to the third embodiment after mating.

FIG. 10 and FIG. 11 show a third embodiment of the present invention. The difference of this embodiment from the first embodiment and the second embodiment exists in that: the grounding members 3 are not provided with the fixing arms 34, and each of the insulating members 5' is directly injection-molded and wrap outside the connecting portions 42' of a corresponding one pair of the differential signal pairs 46. When the mating component 300 is mated, the contact portions 41' of the differential signal pairs 46 are electrically connected with the mating component 300 and then move to positions where the contact portions 41 are located, such that the connecting portions 42' of a corresponding one pair of the differential signal pairs 46 and a corresponding one of the insulating members 5' may move together toward a direction away from the mating component 300 to reach positions where the connecting portions 42 and the insulating members 5 are located. In the whole mating process, the insulating members 5' are not in contact with the mating component 300 and maintain identical contact areas with the differential signal pairs 46.

In sum, the electrical connector according to certain embodiments of the present invention has the following beneficial effects:

1. The insulating members 5 are provided to have the dielectric constants greater than that of the air to be in contact with the differential signal pairs 46, ensuring that the terminals 4 can elastically deform normally during mating of the mating component 300, and reducing the impedance of the differential signal pairs 46, so as to make the portion of each terminal 4 being exposed in the air and the portion of each terminal 4 being located inside the upper insulating body 1 and the lower insulating body 2 reach an impedance balance state, thus achieving improvement of the high-frequency characteristics.

2. The insulating members 5 are provided with the first inclined surfaces 51 and the second inclined surfaces 51'. When the connecting portions 42 of the differential signal pairs 46 move to be in contact with the insulating members 5, the contact areas between the connecting portions 42 of the differential signal pairs 46 and the insulating members 5 are large enough to ensure an impedance adjusting effect.

3. When the mating component 300 is completely mated, the contact areas of the insulating members 5 and the connecting portions 42 of the differential signal pairs 46 reach the maximum value, thus achieving the optimal impedance adjusting effect.

4. The insulating members 5 and the fixing arms 34 are injection-molded to better fix the insulating members 5.

5. When the mating component 300 is mated, the mating component 300 is electrically connected with the terminals 4, the terminals 4 elastically deform in the vertical direction, and the differential signal pairs 46 are in contact with the insulating members 5, so as to better provide a normal force, such that the terminals 4 and the mating component 300 are in stable contact.

6. The insulating members 5 are provided on the connecting portions 42 of the differential signal pairs 46 and are located in the reserved slots 62 without being exposed from the socket 61, so as to prevent the mating component 300 from being in contact with the insulating members 5, which may cause the contact portions 41 not to be in complete contact with the mating component 300 and thereby affecting the performance of the electrical connector 100.

7. When the mating component 300 is not mated, the insulating members 5 and the differential signal pairs 46 are not in contact and have gaps therebetween, such that the mating component 300 may be mated with a lower insertion force during mating and is easier to insert therein.

8. The insulating members 5' are injection-molded on the differential signal pairs 46, so as to ensure that the insulating members 5' and the differential signal pairs 46 have enough contact areas, which may prevent the mating component 300 from not providing a sufficient force for the differential signal pairs 46 during mating, such that the differential signal pairs 46 and the insulating members 5' are not in completely contact, and thus does not achieve adjustment to the impedance.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to be mated with a mating component, the electrical connector comprising:

a main body, extending along a transverse direction, wherein the main body has a grounding member, and at least one fixing arm extends from the grounding member;

a plurality of terminals, fixed to the main body and arranged along the transverse direction; and at least one insulating member, connected with the main body and provided above the terminals, wherein when the mating component is mated with the electrical connector, the terminals are electrically connected with the mating component, and each of the at least one insulating member is in contact with at least one corresponding terminal of the terminals, such that the insulating member moves in a vertical direction, wherein the at least one fixing arm is connected with the insulating member.

2. The electrical connector according to claim 1, wherein the terminals comprise at least one pair of differential signal terminals, and when the mating component is not mated with the electrical connector, the insulating member is in contact with the at least one pair of differential signal terminals.

3. The electrical connector according to claim 1, wherein when the mating component is not mated with the electrical connector, the insulating member is in contact with the at least one corresponding terminal, a contact area of the insulating member and the at least one corresponding terminal when the mating component is not mated with the electrical connector is smaller than the contact area of the insulating member and the at least one corresponding terminal when the mating component is completely mated with the electrical connector.

4. The electrical connector according to claim 1, wherein the insulating member is not in contact with the mating component.

5. The electrical connector according to claim 1, wherein the insulating member has an inclined surface, a portion of the inclined surface is not in contact with the at least one corresponding terminal when the mating component is not mated with the electrical connector, and the whole inclined surface is in contact with the at least one corresponding terminal when the mating component is completely mated with the electrical connector.

6. The electrical connector according to claim 5, wherein:

the inclined surface is a lower surface of the insulating member slantly extending upward and backward from front thereof, and the inclined surface comprises a first region and a second region provided in a front-rear direction;

when the mating component is not mated with the electrical connector, only the first region is in contact with an upper surface of each of the at least one corresponding terminal; and when the mating component is mated with the electrical connector and is in contact with the lower surface of each of the terminals, both the first region and the second region are in contact with the upper surface of each of the at least one corresponding terminal.

7. The electrical connector according to claim 1, wherein each of the terminals comprises an extending section extending out of the main body, and the insulating member is provided on the extending section.

8. The electrical connector according to claim 7, wherein the extending section comprises a contact portion located at a front end thereof and a connecting portion extending backward from the contact portion, the contact portion is electrically connected with the mating component, and the insulating member is located right above the connecting portion.

9. The electrical connector according to claim 7, further comprising a plurality of insulating members and a shell accommodating the main body, the terminals and the insulating members, wherein the shell has a socket and a plurality of reserved slots located at one side of the socket and communicated with the socket, each of the insulating members is accommodated in at least one corresponding reserved slot of the reserved slots, and the extending section of each of the terminals is accommodated in a corresponding one of the reserved slots and is partially exposed from the socket.

10. An electrical connector configured to be mated with a mating component, the electrical connector comprising:

a main body, extending along a transverse direction, wherein the main body has a grounding member, and at least one fixing arm extends from the grounding member;

a plurality of terminals, fixed to the main body and arranged along the transverse direction, wherein the terminals comprises at least one pair of differential signal terminals; and at least one insulating member, connected with the main body and provided on at least one corresponding pair of the differential signal terminals, wherein when the mating component is mated with the electrical connector, the mating component is electrically connected with the terminals, each of the at least one insulating member is in contact with the at least one corresponding pair of differential signal terminals, and the at least one corresponding pair of differential signal terminals drives a corresponding one of the at least one insulating member to move, wherein the at least one fixing arm is connected with the insulating member.

11. The electrical connector according to claim 10, wherein the insulating member is attached to surfaces of the at least one corresponding pair of the differential signal terminals.

12. The electrical connector according to claim 10, wherein when the mating component is not mated with the electrical connector, the insulating member is in contact with the at least one corresponding pair of the differential signal terminals, a contact area of the insulating member and the at least one corresponding pair of the differential signal terminals when the mating component is not mated with the electrical connector and the contact area of the insulating member and the at least one corresponding pair of the differential signal terminals when the mating component is completely mated with the electrical connector are different.

13. The electrical connector according to claim 10, wherein when the mating component is completely mated with the electrical connector, the mating component is electrically connected with a lower surface of each of the at least one corresponding pair of the differential signal terminals, the insulating member has an inclined surface, and a contact area of the inclined surface and upper surfaces of each of the at least one corresponding pair of the differential signal terminals reaches a maximum value.

14. The electrical connector according to claim 10, wherein:

the insulating member has an inclined surface slantly extending upward and backward from front thereof, and the inclined surface comprises a first region and a second region provided in a front-rear direction;

when the mating component is not mated with the electrical connector, a contact area of the first region and upper surfaces of the at least one corresponding pair of the differential signal terminals is larger than a contact area of the second region and the upper surfaces of the at least one corresponding pair of the differential signal terminals; and when the mating component is completely mated with the electrical connector, the contact area of the first region and the upper surfaces of the at least one corresponding pair of the differential signal terminals is smaller than the contact area of the second region and the upper surfaces of the at least one corresponding pair of the differential signal terminals.

15. The electrical connector according to claim 10, wherein when the mating component is mated with the electrical connector, the differential signal terminals are in contact with the mating component, each of the at least one insulating member is in contact with the at least one corresponding pair of the differential signal terminals, and the insulating member moves in a vertical direction and a front-rear direction simultaneously.

16. The electrical connector according to claim 10, wherein each of the terminals comprises an extending section extending out of the main body, and the insulating member is provided on the extending section of the at least one corresponding pair of the differential signal terminals.

17. The electrical connector according to claim 16, further comprising a plurality of insulating members and a shell accommodating the main body, the terminals and the insulating members, wherein the shell has a socket and a plurality of reserved slots located at one side of the socket and communicated with the socket, each of the at least one pair of the differential signal terminals and a corresponding one of the insulating members are accommodated in a corresponding pair of the reserved slots, the two reserved slots in each pair of the reserved slots are in communication with each other, and the extending section of each of the terminals is accommodated in a corresponding one of the reserved slots and is partially exposed from the socket.

18. An electrical connector configured to be mated with a mating component, the electrical connector comprising:

a main body, extending along a transverse direction;

a plurality of terminals, fixed to the main body and arranged along the transverse direction, wherein the terminals comprises at least one pair of differential signal terminals; and at least one insulating member, connected with the main body and provided on at least one corresponding pair of the differential signal terminals, wherein when the mating component is mated with the electrical connector, the mating component is electrically connected with the terminals, each of the at least one insulating member is in contact with the at least one corresponding pair of differential signal terminals, and the at least one corresponding pair of differential signal terminals drives a corresponding one of the at least one insulating member to move, wherein when the mating component is not mated with the electrical connector, the insulating member is in contact with the at least one corresponding pair of the differential signal terminals, a contact area of the insulating member and the at least one corresponding pair of the differential signal terminals when the mating component is not mated with the electrical connector and the contact area of the insulating member and the at least one corresponding pair of the differential signal terminals when the mating component is completely mated with the electrical connector are different.

19. The electrical connector according to claim 18, wherein when the mating component is completely mated with the electrical connector, the mating component is electrically connected with a lower surface of each of the at least one corresponding pair of the differential signal terminals, the insulating member has an inclined surface, and a contact area of the inclined surface and upper surfaces of each of the at least one corresponding pair of the differential signal terminals reaches a maximum value.

20. The electrical connector according to claim 18, wherein:

the insulating member has an inclined surface slantly extending upward and backward from front thereof, and the inclined surface comprises a first region and a second region provided in a front-rear direction;

when the mating component is not mated with the electrical connector, a contact area of the first region and upper surfaces of the at least one corresponding pair of the differential signal terminals is larger than a contact area of the second region and the upper surfaces of the at least one corresponding pair of the differential signal terminals; and when the mating component is completely mated with the electrical connector, the contact area of the first region and the upper surfaces of the at least one corresponding pair of the differential signal terminals is smaller than the contact area of the second region and the upper surfaces of the at least one corresponding pair of the differential signal terminals.

* * * * *